US006601479B1

(12) United States Patent
Kramer

(10) Patent No.: US 6,601,479 B1
(45) Date of Patent: Aug. 5, 2003

(54) SELF ADJUSTING LOCKING PLIERS

(76) Inventor: Solomon Kramer, 3450 S. Ocean Blvd., Apt. 426, Palm Beach, FL (US) 33480

( * ) Notice: Subject to any disclaimer, the term of this patent is extended or adjusted under 35 U.S.C. 154(b) by 0 days.

(21) Appl. No.: 10/101,862

(22) Filed: Mar. 21, 2002

(51) Int. Cl.[7] ..... B25B 7/14; B25B 7/12

(52) U.S. Cl. ..... 81/319; 81/320; 81/366

(58) Field of Search ..... 81/318–320, 324, 81/325, 367, 358, 342, 340, 364, 366, 372–384, 385

(56) References Cited

U.S. PATENT DOCUMENTS

| | | | | | |
|---|---|---|---|---|---|
| 293,848 | A | * | 2/1884 | Brown | 81/366 |
| 430,768 | A | * | 6/1890 | Cooper | 81/366 |
| 823,367 | A | * | 6/1906 | Ryan | 81/366 |
| 1,879,452 | A | * | 9/1932 | Palotce | 81/319 |
| 1,915,404 | A | * | 6/1933 | Clifton | 81/366 |
| 1,944,116 | A | * | 1/1934 | Stratman | 81/320 |
| 2,324,415 | A | * | 7/1943 | Moss | 81/366 |
| 2,439,785 | A | * | 4/1948 | Feitl et al. | 81/319 |
| 4,538,485 | A | * | 9/1985 | Saila | 81/320 |

* cited by examiner

*Primary Examiner*—D. S. Meislin
(74) *Attorney, Agent, or Firm*—Stevens, Davis, Miller & Mosher, LLP

(57) ABSTRACT

A hand tool for gripping an article in locking relation generally consisting of a pair of elongated members connected together for pivotal movement about a first axis, providing a pair of jaw portions at one set of ends thereof cooperable to engage the article therebetween and a pair of handle portions adapted to be grasped by a hand of the user thereof; one of the handle portion including a segment having an arcuate surface disposed coaxially with the first axis; and a lever member connected to the other of the elongated members for pivotal movement about a second axis, having a first end engageable by at least one finger of the user's hand grasping the handle portions of the elongated members when the jaw portions thereof engage the article therebetween, for angularly displacing the lever member about the second axis, and a second end engageable with the arcuate surface in wedging relation to lock the article between the jaw portions of the elongated members.

19 Claims, 2 Drawing Sheets

SELF ADJUSTING LOCKING PLIERS

This invention relates to a self adjusting mechanism incorporated into a pliers that enables the user to grip and lock the pliers using only one hand during the operation.

BACKGROUND OF INVENTION

Pliers are used in a variety of situations to grip a bolt, nut, wire, or other items. The general design uses the leverage of two elongated pieces having a handle portion at one end and a jaw piece at the other end. Both pieces are connected together at a pivot pin. When the handle portions are squeezed together, the jaws of the pliers grab the object desired. The length of the handle portions determines the amount of gripping power of the jaws.

Various locking mechanisms are on the market, such as the popular vise grips. These locking mechanisms use a series of hinges to lock the jaws of the pliers together. However, while a first hand grips the handles of the pliers, the other hand is used to turn a screw to adjust the locking mechanism. This means that the items to be gripped must be placed into the jaws snugly prior to the adjustment of the locking mechanism. Thus, such a mechanism requires the use of two hands in order to effectively grip and adjust the locking mechanism to lock an item with the vise grips.

SUMMARY OF INVENTION

An object this invention is to overcome the problem of using both hands to lock the pliers. This allows the user to perform other tasks with a free hand prior to and during the gripping and locking of the pliers. The invention overcomes this problem and others by providing pliers that allow for a single hand to hold and lock pliers. The locking mechanism comprises an arc shaped surface connected to one handle, and a hinged pressure contact on the other handle. The user uses a free finger on the hand gripping the pliers to pull a lever on the pressure contract to engage the pressure contact with the arc shaped surface. The contact transfers pressure to the jaws of the pliers to better hold an item in the jaws, while friction at the contact point keeps the handle with the pressure contact from moving with respect to the arc surface.

BRIEF DESCRIPTION OF THE DRAWINGS

Preferred embodiments of the invention will now be described in detail in association with drawings of which.

DETAILED DESCRIPTION OF THE INVENTION

Figure 1:
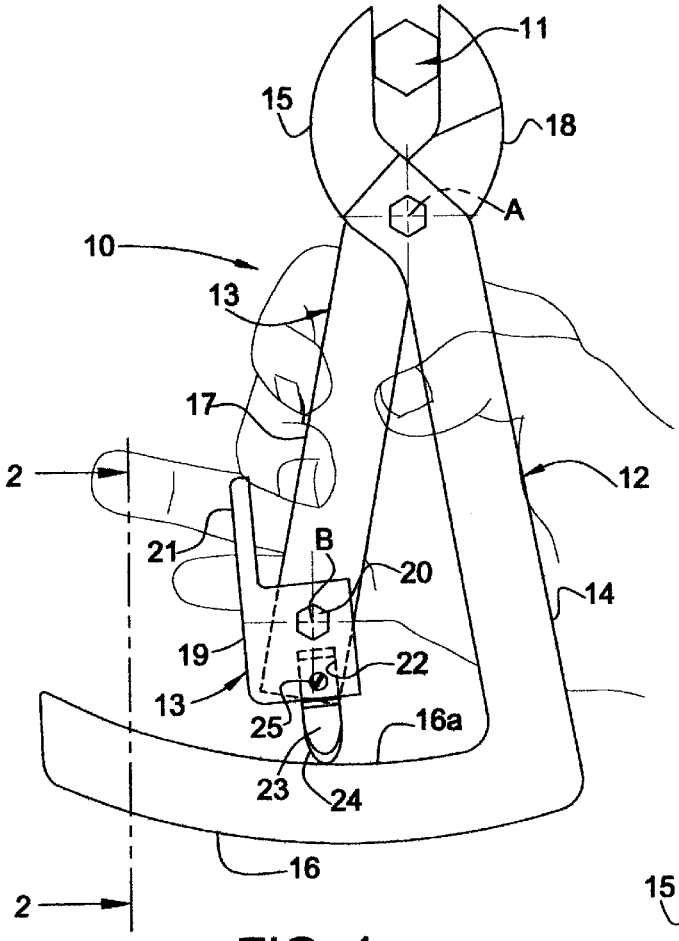
FIG. 1 is a perspective view of the pliers in an unlocked position.

Referring to the FIG. 1, pliers according to a first embodiment of the invention has a pair of elongated members 190 and 195 hinged connected together by a plier hinge pin 130. Jaw member 110 is the upper portion of elongated member 195 and jaw member 120 is the upper portion of elongated member 190. A work piece 100 may be inserted between the jaw members. Elongated member 190 has a lower handle portion 150 and elongated member 195 has a lower handle portion 140. A user of the pliers grips the pliers at handle members 140 and 150 as shown by the ghost hand in FIG. 1. Upon a squeezing of the handles together, the jaw members 110 and 120 are brought together by virtue of hinge pin 130, thus clamping down on work piece 100. The length of the pliers from hinge pin 130 to the place where the user grips the handle members determines the amount of clamping force between jaw members 110 and 120.

Figure 2:
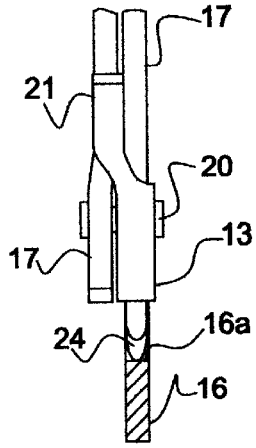
FIG. 2 is a view in the direction of line 2—2 in FIG. 1.

The locking mechanism works using an arc shaped surface 160 on the inside of a locking bar 155, which is connected to a bottom portion of handle member 150. Arc shaped surface 160 follows along an imaginary circle having a center at plier hinge pin 130. On the other handle member 140, a hinged lever 170 is connected at a bottom end via a hinge pin 135. A finger lever 175 allows the user to rotate hinged lever 170 with the use of fingers on the hand which hold the pliers. A pressure contact 180 interconnected to hinged lever 170 via a set screw 185 extends away from hinge pin 135. Set screw 185 is used to adjust how far away from hinged lever 170 pressure contact 180 will extend. As shown in FIG. 2, pressure contact 180 has a point 185 that travels along the middle width of arc shaped surface 160.

Figure 3:
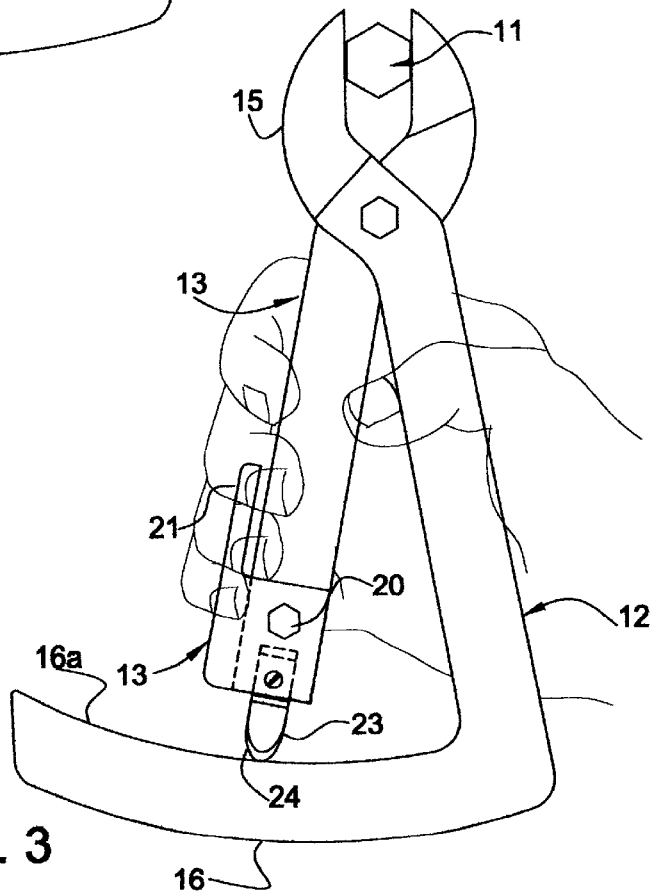
FIG. 3 is perspective view of the pliers in a locked position.

Ideally, the combination of distances between the center of plier hinge pin 130 to hinge pin 135 and between hinge pin 135 to the tip of pressure contact 185 will be greater than the distance between the center of plier hinge pin 130 and arc shaped surface 160. Upon rotation of the hinged lever 170 via use of the fingers as shown in FIG. 3, the pressure contact 180 contacts arc shaped surface 160. By friction at this contact point, pressure contact 180 does not move with respect to arc shaped surface 160. Upon continual rotation of hinged lever 170 to a position where finger lever 175 is parallel with handle member 140 and pressure contact 180 extends along a line parallel to the handle member 140, handle member 140 is brought closer together to opposing handle member 150, which provides an increased clamping force between the jaw members 110 and 120. Note how handle members 140 and 150 are closer as shown by angle $\beta$ together in FIG. 3 compared with angle $\alpha$ from FIG. 1 upon the locking of the pliers via the rotation of finger lever 175. As long as the user continually squeezes the handle members 140 and 150 and simultaneously holds finger lever 175 parallel to the handle member 140, jaw members 110 and 120 are locked in a clamping position, securing work piece 100. Further, the rotation of the hinged lever 170 provides a mechanism for applying more torque between the jaw members 110 and 120 than the user could by only squeezing the handle members 140 and 150 together.

Figure 4:
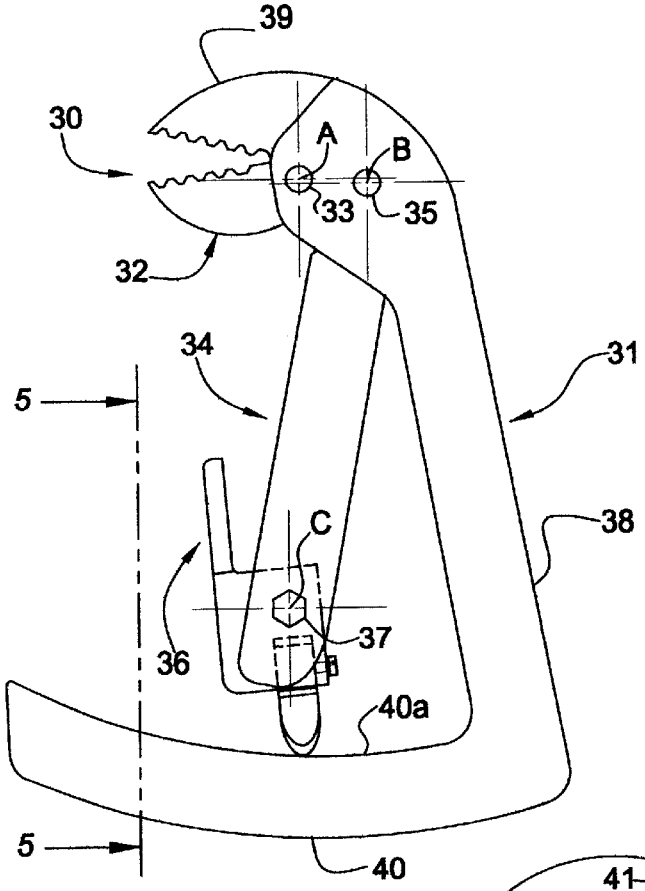
FIG. 4 is a perspective view of a second embodiment of the invention in the unlocked position.
Figure 5:
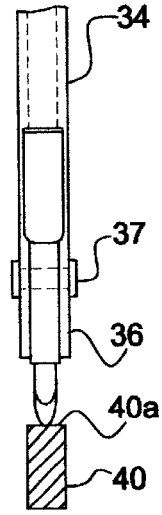
FIG. 5 is a view in the direction of line 5—5 in FIG. 4.
Figure 6:
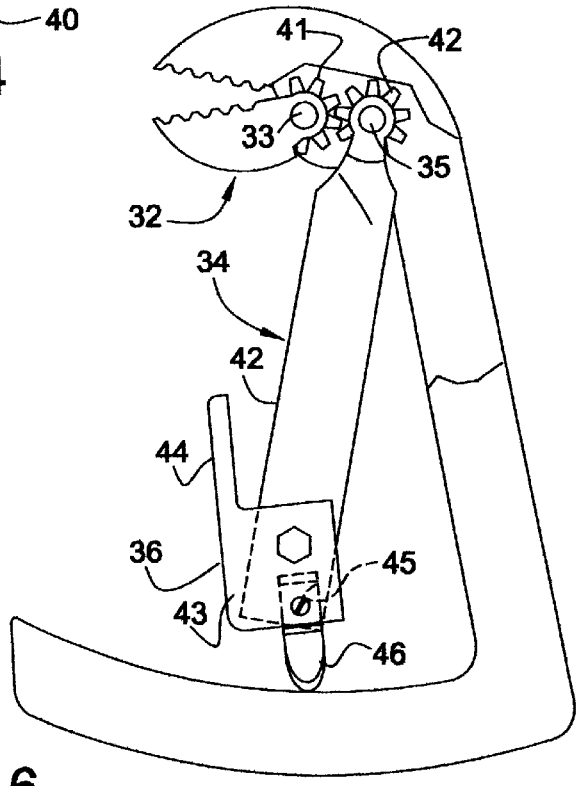
FIG. 6 is a cut away view showing the gearing of the pliers according to the second embodiment.

In FIGS. 4–6, another embodiment according to the invention is shown. Rather than the jaw members being in a direction relatively parallel the elongated members as was shown in the first embodiment, this embodiment uses a pair of jaw members 545 and 555 which are relatively perpendicular to elongated members 540 and 550 (Shown in FIG. 4).

The pliers comprises an upper jaw member 555 and a lower jaw member 545. The upper jaw member is integrally connected to elongated member 550. As shown in FIG. 6, the lower jaw member 545 is hinge connected to elongated member 550 via a jaw pin 630, which allows lower jaw member 545 to rotate about jaw pin 630 to clamp onto items place between upper and lower jaw members 555 and 545. Lower jaw member 545 has jaw gears 620 which are operably connected to elongated member 540 via gears 600. The interaction of jaw gears 620 and gears 600 provide that a squeezing of the elongated members 540 and 550 together at their respective handle portions 570 and 580 will cause lower jaw member 545 to rotate towards upper jaw member 555, enabling the pliers to clamp an object. As shown in FIG. 5, such a design allows for the pliers to be constructed narrower than the pliers of the first embodiment.

The locking mechanism of the second embodiment utilizes the same locking mechanism as was disclosed in the first embodiment with the use of hinged lever 170 in conjunction with arc shaped surface 160 on the bottom portion 155 of one of the elongated members.

From the foregoing detailed description, it will be evident that there are a number of changes, adaptations and modifications of the present invention, which come within the province of those persons having ordinary skill in the art to which the aforementioned invention pertains. However, it is intended that all such variations not departing from the spirit of the invention be considered as within the scope thereof as limited solely by the appended claims. For example, the novel features of this invention could be used in pliers having various other shapes, sizes or having jaws oriented in other directions. Further, this invention could be used in other items and should not be limited to pliers. For example, any tool requiring the squeezing together of a pair of handle members could incorporate this invention to provide a locking mechanism or as a method of adding a extra torque between the handle members.

I claim:

1. A hand tool for gripping an article in locking relation comprising:

a pair of elongated members connected together for pivotal movement about a first axis, each having an opposing jaw portion at an end thereof and a handle portion, said handle portions adapted to be grasped by a hand of the user thereof and said jaw portions cooperable to engage an article therebetween;

one of said handle portions including a segment having an arcuate surface disposed concentric with said first axis; and a lever member connected to the other of said elongated members for pivotal movement about a second axis having a first end thereof engageable by at least one finger of the user's hand grasping said handle portions when said jaws engage said article therebetween, for angularly displacing said lever member about said second axis and a second end engageable with said arcuate surface, wherein upon angular displacement of said lever member by said at least one finger of the user's hand following engagement of said article between said jaw portions, said second end is thrust into said arcuate surface preventing movement therebetween and a combination of said angular displacement and said thrust contact increases a gripping pressure between said jaw portions.

2. A hand tool according to claim 1 wherein said first and second axes are parallel.

3. A hand tool according to claim 1 wherein the sum of a radial dimension from said first axis to said second axis and a radial dimension from said second axis to said second end of said lever member is greater than a radial dimension of said first axis to said arcuate surface.

4. A hand tool according to claim 1 wherein said second end of said lever member is displaceable angularly relative to said second axis.

5. A hand tool according to claim 1 wherein said lever member includes a first portion including said first end pivotally connected to said other handle portion and a second portion including said second end, displaceable angularly relative to said second axis, and including means for fixing the position of said second lever portion relative to said first lever portion.

6. A hand tool according to claim 1 wherein said second end of said lever member is rounded.

7. A hand tool according to claim 1 wherein said second end of said lever member projects beyond the handle portion of said other elongated member.

8. A hand tool according to claim 1 wherein the handle portion of said one elongated member includes a laterally projecting segment and said arcuate surface is provided thereon.

9. A hand tool according to claim 8 wherein said handle portion of said other elongated member is shorter than the handle portion of said one elongated member, and said second axis is disposed adjacent a free end of the handle portion of said other elongated member.

10. A hand tool according to claim 1 wherein said elongated members are formed of flat metal stock.

11. A hand tool for gripping an article in locking relation comprising:

a pair of elongated members connected together for pivotal movement about a first axis;

one of said elongated members having a jaw portion, a handle portion and a portion including an arcuate surface disposed concentric with said first axis;

a jaw member connected to said one elongated member for pivotal movement about a second axis, cooperable with said jaw portion of said one elongated member to engage said article therebetween and having a gear sector portion disposed coaxially with said second axis;

the other of said elongated members having a gear sector portion disposed coaxially with said first axis and meshing with said gear sector portion of said jaw member, and a handle portion which may be grasped along with the handle portion of said one elongated member by a hand of a user and drawn together to cause said jaw member to angularly displace relative to said second axis to grip said article disposed between said jaw member and said jaw portion of said one elongated member; and a lever member connected to said other elongated member for pivotal movement about a third axis having a first end engageable by at least one finger of the user's hand grasping said handle portions when said jaw member and said jaw portion engage said article therebetween, for angularly displacing said lever member about said third axis, and a second end engageable with said arcuate surface, wherein upon angular displacement of said lever member by said at least one finger of the user's hand following engagement of said article between said jaw member and said jaw portion, said second end is thrust into said arcuate surface preventing movement therebetween and a combination of said angular displacement and said thrust contact increases a gripping pressure between said jaw member and said jaw portion.

12. A hand tool according to claim 11 wherein said axes are parallel.

13. A hand tool according to claim 11 wherein the sum of a radial dimension from said first axis to said third axis and a radial dimension from said third axis to said second end of said lever member is greater than a radial dimension from said first axis to said arcuate surface.

14. A hand tool according to claim 11 wherein said second end of said lever member is displaceable angularly relative to said third axis.

15. A hand tool according to claim 11 wherein said lever member includes a first portion including said first end, pivotally connected to the handle portion of said other elongated member and a second portion including said second end, displaceable angularly relative to said third axis, and including means for fixing the position of said second lever portion relative to said first lever portion.

16. A hand tool according to claim 11 wherein said second end of said lever member is rounded.

17. A hand tool according to claim 11 wherein said second end of said lever member projects beyond the handle portion of said other elongated member.

18. A hand tool according to claim 11 wherein the handle portion of said one elongated member includes a laterally projecting segment and said arcuate surface is provided on said segment.

19. A hand tool according to claim 18 wherein said handle portion of said other elongated member is shorter than the handle portion of said one elongated member, and said third axis is disposed adjacent a free end of the handle portion of said other elongated member.

* * * * *